US008789484B2

(12) United States Patent
Donaldson et al.

(10) Patent No.: US 8,789,484 B2
(45) Date of Patent: Jul. 29, 2014

(54) EASILY TRANSPORTABLE PERSONAL WATERCRAFT

(75) Inventors: Clint Donaldson, Broken Arrow, OK (US); David Yonce, Broken Arrow, OK (US)

(73) Assignee: Boat in a Box, LLC, Bixby, OK (US)

( * ) Notice: Subject to any disclaimer, the term of this patent is extended or adjusted under 35 U.S.C. 154(b) by 141 days.

(21) Appl. No.: 13/404,768

(22) Filed: Feb. 24, 2012

(65) Prior Publication Data

US 2013/0220192 A1 Aug. 29, 2013

(51) Int. Cl.
*B63B 35/73* (2006.01)

(52) U.S. Cl.
USPC ..... 114/55.57; 114/345; 114/123; 114/354; 114/55.5

(58) Field of Classification Search
USPC ..... 114/55.57, 347, 354, 123, 345
See application file for complete search history.

(56) References Cited

U.S. PATENT DOCUMENTS 4,320,713 A * 3/1982 Nishida et al. ..... 114/123
4,838,817 A * 6/1989 Travis ..... 440/6
5,081,947 A * 1/1992 Holden ..... 114/345
5,282,437 A * 2/1994 Avillez de Basto ..... 114/345
5,544,607 A * 8/1996 Rorabaugh et al. ..... 114/123
5,601,461 A * 2/1997 Mills ..... 440/6
5,836,794 A 11/1998 Krueger
6,213,821 B1 * 4/2001 Bernloehr et al. ..... 440/6
6,334,402 B1 * 1/2002 Gilligan ..... 114/354
2007/0125285 A1 * 6/2007 Conrad ..... 114/55.5
2008/0060569 A1 * 3/2008 Howard et al. ..... 114/347
2013/0220192 A1 * 8/2013 Donaldson et al. ..... 114/55.57

FOREIGN PATENT DOCUMENTS

WO PCTUS2013027646 6/2013

* cited by examiner

*Primary Examiner* — Lars A Olson
*Assistant Examiner* — Jovon Hayes
(74) *Attorney, Agent, or Firm* — David G. Woodral; Fellers, Snider, Blankenship, Bailey & Tippens, P.C.

(57) ABSTRACT

A personal watercraft has a saddle with a seating surface, first and second opposite sides, and front and back ends. A pair of footing surfaces proceed from proximate lower edges of first and second opposite sides. A front recess is defined in the front end and has upper and lower portions that extend further away from the saddle than a medial portion. A back recess is defined in the back end and has upper and lower portions that extend further away from the saddle than a medial portion. The front and back recesses are configured to secure an inflatable body that substantially surrounds the saddle with the footing surfaces at least partially exposed.

19 Claims, 3 Drawing Sheets

EASILY TRANSPORTABLE PERSONAL WATERCRAFT

FIELD OF THE INVENTION

This disclosure relates to watercraft in general and, more specifically, to portable personal watercraft.

BACKGROUND OF THE INVENTION

Personal watercrafts are enjoyed by a wide variety of consumers for many reasons. Recreation, relaxation, and even fitness are a few examples. In some cases, a personal watercraft may be used as a tool in pursuit of another hobby, such as hunting or fishing. In the past, tradeoffs were necessary. A personal watercraft is often designed to be used by one (or no more than a few) at a time. Ideally, such watercraft would be highly portable. However, portability often comes at the cost of decreasing the usefulness of the personal watercraft. For example, even common two man fishing boats require a large truck or small trailer to transport. An inflatable raft would be much more portable but at the expense of the utility of the slightly larger watercraft.

What is needed is a device for addressing the above, and related, concerns.

SUMMARY OF THE INVENTION

The invention of the present disclosure, in one aspect thereof comprises a personal watercraft having a saddle with a seating surface, first and second opposite sides, and front and back ends. A pair of footing surfaces proceed from proximate lower edges of first and second opposite sides. A front recess is defined in the front end and has upper and lower portions that extend further away from the saddle than a medial portion. A back recess is defined in the back end and has upper and lower portions that extend further away from the saddle than a medial portion. The front and back recesses are configured to secure an inflatable body that substantially surrounds the saddle with the footing surfaces at least partially exposed.

In some embodiments the device includes a water displacing body that is secured to the saddle via the front and back recesses. The body may be inflatable and substantially toroidal in shape. The water displacing body may be affixed to an upper side of the footing surfaces. The footing surfaces may be hinged to the sides of the saddle such that, in a first position, the footing surfaces present a substantially horizontal surface and, in a second position, fold substantially flat against the sides of the saddle.

In some embodiments a passage is defined in the saddle and proceeds vertically therethrough for mounting a motor. Some embodiments also have a motor support insert occupying at least a portion of the passage defined in the saddle, the motor support insert providing a substantially v-shaped base that passes the motor shaft therethough. Some embodiments have wedge member having at least two positions, a first of which provides a groove in which a motor shaft may rest in a substantially horizontal position, and a second of which locks the motor shaft into a vertical position in the motor support insert. The base may also provide a guide groove for guiding the shaft into a horizontal position when the wedge member is in the first position.

The personal watercraft may also comprise a motor having a control head and a propeller assembly at opposite ends of a shaft, the shaft comprising upper and lower shaft pieces connected by a hinge such that the propeller assembly may be retracted toward the saddle and the upper shaft pieces placed substantially horizontal on the saddle.

The invention of the present disclosure, in another aspect thereof, comprises another embodiment of a personal watercraft that includes a saddle having a substantially vertical passage therethrough, and a motor having a control head on an upper end attached to an upper shaft, and having a propeller assembly on a lower and attached to a lower shaft, the upper and lower shaft connecting by a hinge. The propeller assembly may be retracted and the hinge bent such that the upper shaft may lie substantially horizontally over the saddle while the lower shaft remains in the passage. The hinge may be straightened and the propeller assembly extended by moving the upper shaft at least partially into the passage.

In some embodiments, the personal watercraft further comprises a collar attached to the upper shaft limiting its descent into the vertical passage. A motor support insert may be placed at least partially within the vertical passage, the motor support insert having a first configuration that retains the upper and lower shaft in a fixed coaxial relationship when the propeller unit is extended, and a second configuration where the motor support insert supports the upper shaft in a substantially horizontal position when the propeller unit is retracted. The motor support insert may have a movable wedge member that partially retains the upper shaft in the first configuration and provides a horizontal support in the second configuration.

In some embodiments, the saddle provides a recess on each of two opposite ends, the recesses at least partially retaining an inflatable floatation member. A retractable footrest may be provided on each of two opposite sides of the saddle. The footrests may be attached to the saddle via hinges.

The invention of the present disclosure, in another aspect thereof, comprises a third embodiment of a personal watercraft. The watercraft includes a saddle having a seating surface and an adjacent vertical passageway through the saddle, a motor support insert at least partially occupying the vertical passageway, and a motor having an upper shaft with a control unit and hinged to a lower shaft with a propeller unit. The support insert provides a first configuration that supports the motor with the propeller unit extended by retaining the upper and lower shaft in a fixed relationship but allowing rotation of the shafts, and the support insert provides a second configuration that allows the propeller unit to retract and the upper and lower shaft to bend relative to one another.

In some embodiments, the personal watercraft has a wedge shaped member that provides a horizontal surface that contacts the upper shaft when the propeller unit is extended, and moves with respect to the support insert to provide a substantially horizontal surface that contacts the upper shaft when the propeller unit is retracted. In some embodiments, an electric battery is retained within a cavity in the saddle, and connected to the motor. A floatation member may circumscribe the saddle.

DETAILED DESCRIPTION OF THE PREFERRED EMBODIMENTS

Figure 1:
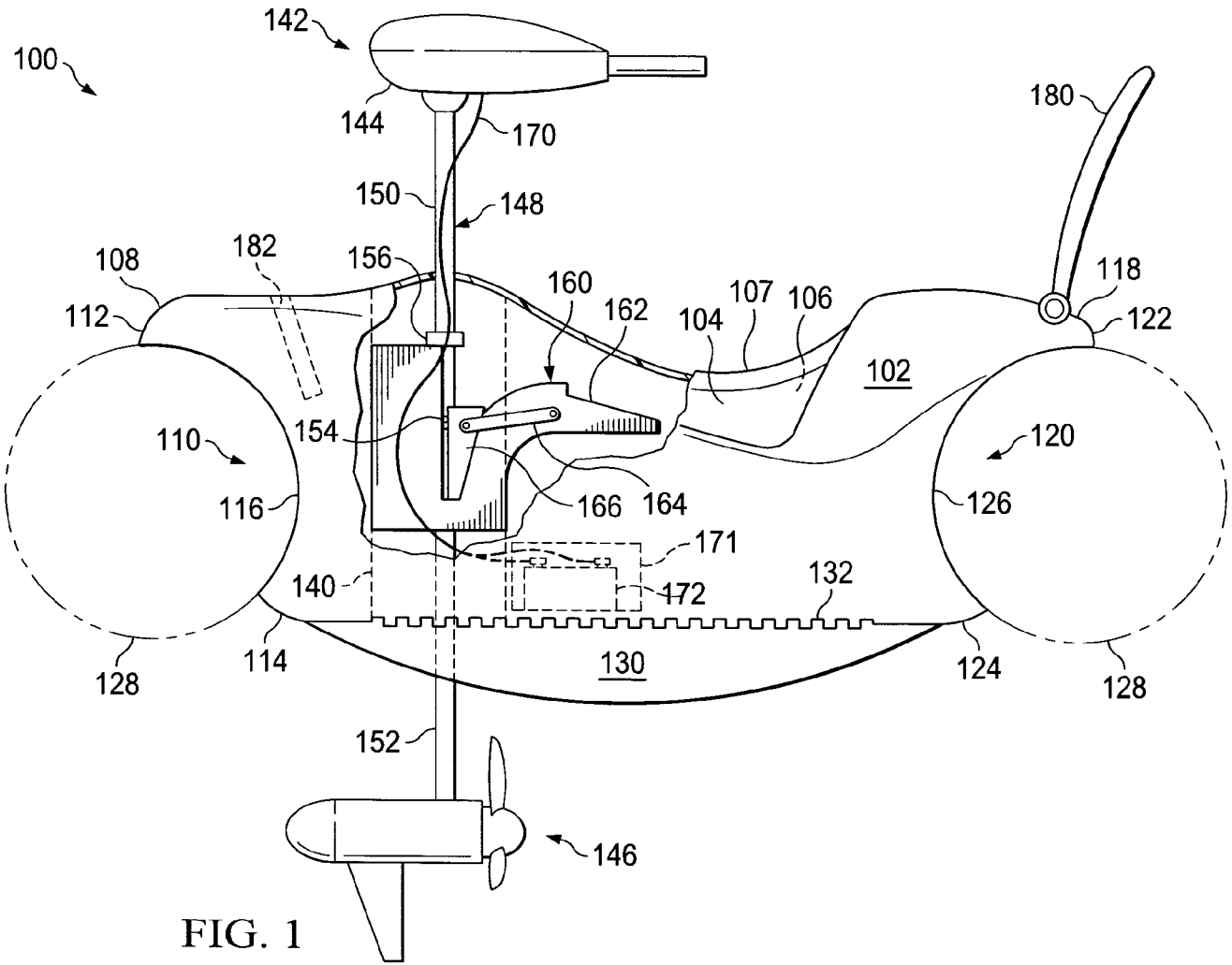
FIG. 1 is a side cutaway view of a personal watercraft according to aspects of the present disclosure.

Referring now to FIG. 1, a side cutaway view of a personal watercraft according to aspects of the present disclosure is shown. The personal watercraft 100 includes a saddle 102. The saddle 102 may comprise a polymer or another suitably resilient material. In the present embodiment, the saddle 102 includes a left side 104 and a right side 106. A seating surface 107 is provided atop the saddle. In some embodiments, the seating surface 107 may be padded for comfort and may also be waterproof and/or UV resistant.

The saddle 102 has a front end 108 that has a recessed area 110. The recessed area 110 is defined by an upper portion 112 and a lower portion 114 that each extend further from the saddle than a medial portion 116. Similarly, the saddle 102 may have a back end 118 having a recessed 120 that may be defined by an upper portion 122 and a lower portion 124 that extend further from the saddle than a medial portion 126.

The shape and configuration of the front end 108 and the back end 118 serve in part to assist in retaining a flotation member 128 to the saddle 102. While the saddle 102 may be somewhat buoyant on its own, the flotation member 128 will serve to allow the watercraft 100 to support a working load on the surface of the water. The floatation members 128 may be user inflatable or may be formed by a closed cell material with inherent buoyancy.

Attached to the left side 104 of the saddle 102, a left foot platform 130 may be attached by a hinge 132. Similarly, the right side 106 of the saddle 102 may have a right foot platform 134 attached by a hinge 136 (out of view). In embodiments where the foot platforms are attached by hinges, the floatation member 128 may be deflated and the left foot platform 130 and right foot platform 134 folded against the respective sides 104, 106 of the saddle 102 to create a compact configuration for transportation and/or storage of the watercraft 100. As described in greater detail below, the watercraft 100 also provides for compact stowage of its own engine.

The saddle 102 defines a passage 140 forward of the seating surface 107. The passage 140 may be appropriately sized to pass and retain a motor 142. The motor 142 may be an electric motor, such as a trolling motor, with certain modifications as described herein. The motor 142 generally includes a control head 144 that is used by the user to control the power output and direction of the motor 142.

A propeller assembly 146 is also provided on an opposite end of the motor 142. In some embodiments, the propeller assembly 146 also includes an electric motor other engine which provides power to propellers to move the watercraft 100.

The control head 144 and the propeller assembly 146 may be connected to one another by a shaft 148. In the present embodiment, the shaft 148 passes through the passage 140 such that the control head 144 will be user accessible while the propeller assembly 146 will be below the surface of the water. In the present embodiment, the shaft 148 comprises an upper shaft 150 and a lower shaft 152 connected by an articulating joint 154. As will be explained in greater detail below, in some embodiments the joint 154 allows the motor 142 to have two distinct positions with respect to the saddle 102. The configuration shown in FIG. 1 is suitable for controlling and powering the direction of the watercraft 100 upon the surface of the water.

In the present embodiment, the passage 140 at least partially contains a motor support insert 160. In the present configuration, the motor support insert 160 includes a base 162 through which all or part of the shaft 148 may pass. An arm 164 secures a wedge member 166 which aids in retaining the upper shaft 152 in a coaxial position with the lower shaft 152. It is understood that neither the passage 140 nor the motor support insert 160 will inhibit rotation of the shaft 148. In this manner, although the upper shaft 150 and lower shaft 152 are retained in a coaxial relationship, they may still be rotated by user control upon the control head 144 such that the propeller assembly 146 may be rotated beneath the surface of the water. In the present embodiment, a collar 156 may be attached along the upper shaft 150 to prevent the motor 142 from traveling too far through the passage 140.

In embodiments that utilize an electrically powered motor such as the motor 142, a power cord 170 may be provided. In the present embodiment, an internal compartment 171 is provided within the saddle 102 for housing an electric battery 172. It is understood that the saddle 102 may have or define various other interior compartments and may also have a portion of the interior dedicated to additional or backup floatation for the watercraft 100. Various other accessories may also be included with or attached to the saddle 102 such as a foldable seatback 180 and fishing rod holder 182.

Figure 2:
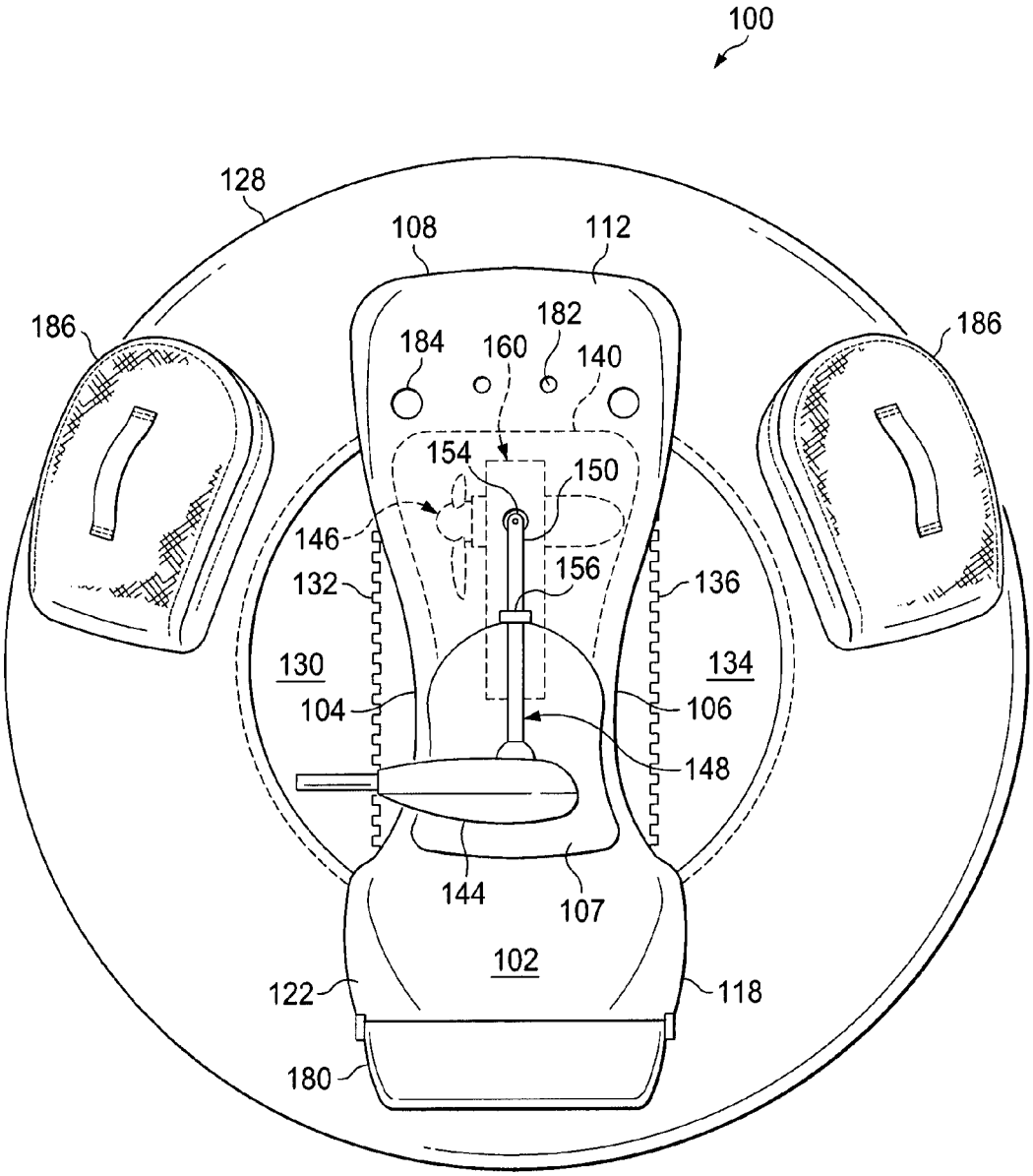
FIG. 2 is an overhead view of the watercraft of FIG. 1.

Referring now to FIG. 2, a top view of the personal watercraft 100 is shown. In the present embodiment, the floatation member 128 is toroidal or donut shaped and inter-fits with the previously described front end 108 and back end 118 of the saddle 102. In the present embodiment, the left foot platform 130 and the right foot platform 134 fold down relative to the saddle 102 before the floatation member 128 is inflated. In this manner, the floatation member 128 may serve to anchor the foot platforms in their downward or extended position. This also prevents at least a degree of water leakage from below the saddle 102.

In some embodiments, the floatation member provides storage pockets 186. Other implements may also be provided (e.g., tie off loops, attachment rings). The floatation member 128 may also be provided with a durable cover, or otherwise colored according to the uses of the watercraft 100 (e.g., brightly or stylistically colored, drab, or camouflaged). In some embodiment, straps or tie off points (not shown) may be used for additional security between the flotation member 128 and the saddle 102.

From the view of FIG. 2, it may be seen how the motor 142 may be retracted up through the passage 140 and allowed to bend at the hinge or joint 154 such that the control head 144 and upper shaft 150 lie substantially horizontally and against the saddle 102. In this configuration, it will be appreciated that the propeller assembly 146 will be substantially retracted into the saddle 102. The propeller assembly may be retracted partially or completely into the passage 140 in the saddle 102. In some embodiments, a lower portion of the passage 140 may be enlarged to accommodate the propeller assembly 146.

Figure 3:
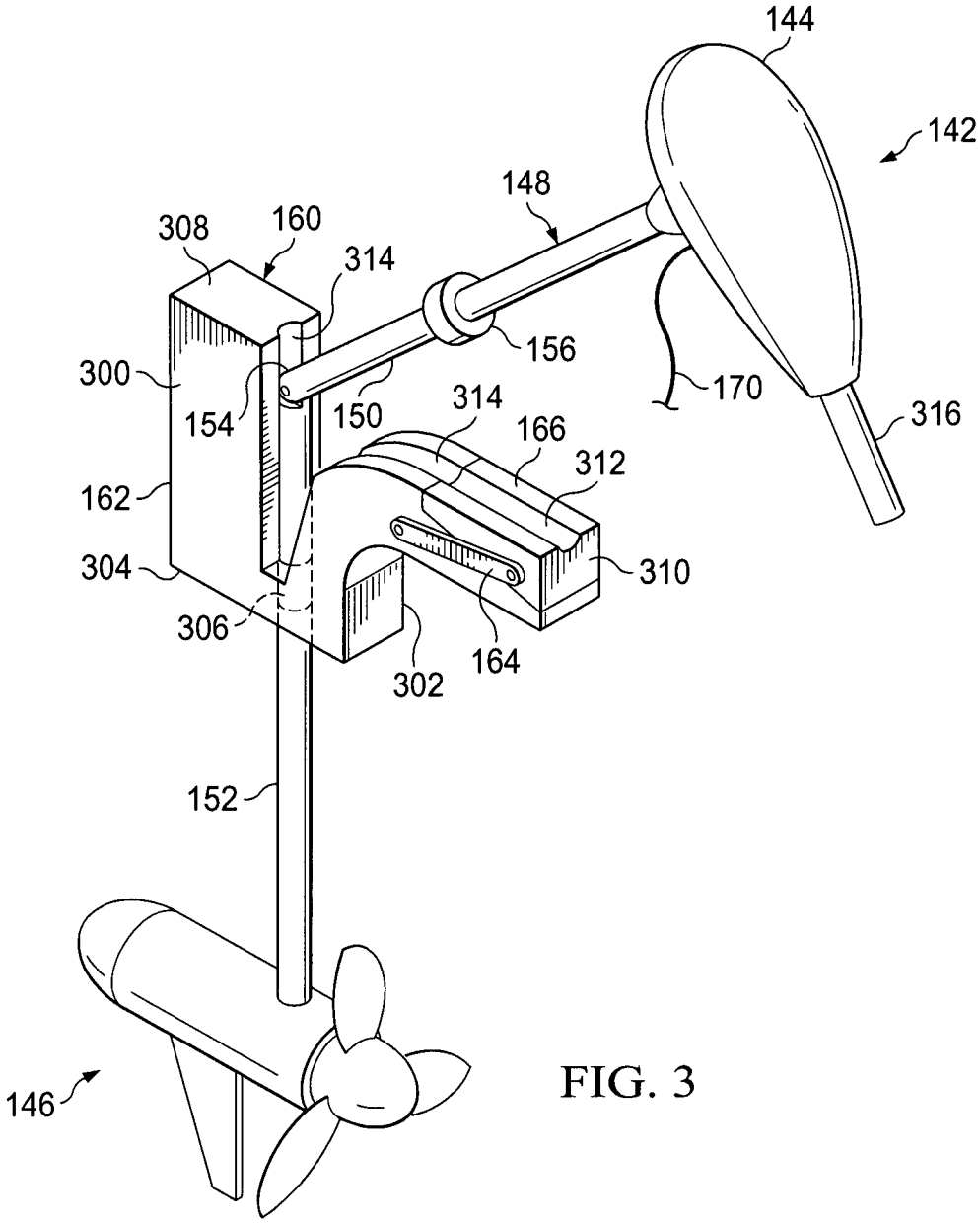
FIG. 3 is a close-up perspective view of a motor support insert for use with the watercraft of FIG. 1.

Referring now to FIG. 3, a close-up perspective view of the motor support insert 160, along with the motor 142, is shown. The view of FIG. 3 illustrates the wedge member 166 retracted away from the base 162 to allow the upper shaft 150 to bend or fold relative to the lower shaft 152 at the joint 154. In some embodiments the joint 154 will have only one degree of freedom such that the control head 144 and the propeller assembly 146 remain at a predetermined angle relative to one another. This may be useful in ensuring that the control head 144, and any handle 316, guide, or other protuberance, will lie on or against the saddle 102 in the most compact and efficient manner possible. Similarly, the propeller assembly 146 may need to be withdrawn into the saddle 102 at substantially the same angle each time for storage. By choosing the angle of the joint 154, it may be assured that the control head 144 and the propeller assembly 146 are always at the correct angle relative to one another. In other embodiments, the joint 154 could be a universal joint such that the control head 144 and propeller assembly 146 would be allowed to lie at different angles relative to one another when the motor 142 is retracted.

In the present embodiment, the base 162 comprises an upright 300 and an upright 302, configured generally in a V-shape. In the present embodiment, the uprights 300 302 are connected by a horizontal connecting member 304 that also provides a passage 306 for the shaft 150. The upright 300 provides a flat surface 308 while an opposite flat surface 310 is provided on the wedge member 166. When the motor 142 is extended, and the wedge member 166 is placed in position against the shaft 150, the collar 156 may rest against the adjacent flat surfaces 308, 310 to control the height and depth of the motor 142 (particularly the propeller assembly 146). The wedge member 166 provides a guide or groove 312 and an opposite guide or groove 314 is provided by the upright 300. The wedge member 166, when closed or locked as shown in FIG. 1, will lie between the upright 302 and the shaft 150 such that the groove 312 in combination with the groove 314 retains the pieces 150, 152 of the shaft 148 in the proper relationship. The dimensions of the shaft 150 and the constituent upper shaft 150 and lower shaft 152 can be chosen such that when the motor 142 is extended or deployed the joint 154 will be within the passage 306 of the connecting member 304. This may provide additional rigidity of the relationship between the upper shaft 150 and the lower shaft 152.

***

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the spirit of this invention as defined by the claims.

What is claimed is:

1. A personal watercraft comprising: a saddle having a seating surface, first and second opposite sides, and front and back ends; a pair of footing surfaces proceeding from proximate lower edges of first and second opposite sides; a front recess defined in the front end and having upper and lower portions that extend further away from the saddle than a medial portion; a back recess defined in the back end and having upper and lower portions that extend further away from the saddle than a medial portion; and a motor having a control head and a propeller assembly at opposite ends of a shaft, the shaft comprising upper and lower shaft pieces connected by a hinge such that the propeller assembly may be retracted toward the saddle and the upper shaft piece placed substantially horizontal on the saddle; wherein the front and back recesses are configured to secure an inflatable body that substantially surrounds the saddle with the footing surfaces at least partially exposed.

2. The personal watercraft of claim 1, further comprising an inflatable body that is secured to the saddle via the front and back recesses.

3. The personal watercraft of claim 2, wherein the inflatable body is substantially toroidal in shape.

4. The personal watercraft of claim 3, wherein the inflatable body is affixed to an upper side of the footing surfaces.

5. The personal watercraft of claim 1, wherein the footing surfaces are hinged to the sides of the saddle such that, in a first position, the footing surfaces present a substantially horizontal surface and, in a second position, fold substantially flat against the sides of the saddle.

6. The personal watercraft of claim 1, further comprising a passage defined in the saddle and proceeding vertically therethrough for mounting a motor.

7. The personal watercraft of claim 6, further comprising a motor support insert occupying at least a portion of the passage defined in the saddle, the motor support insert providing a substantially v-shaped base that passes the shaft therethrough, and a wedge member, the wedge member having at least two positions, a first of which provides a groove in which the upper shaft piece rests in a substantially horizontal position, and a second of which locks the upper and lower shaft pieces into a vertical position in the motor support insert.

8. The personal watercraft of claim 1, wherein the base provides a guide groove for guiding the shaft into a horizontal position when the wedge member is in the first position.

9. A personal watercraft comprising:

a saddle having a substantially vertical passage therethrough; and a motor having a control head on an upper end attached to an upper shaft, and having a propeller assembly on a lower and attached to a lower shaft, the upper and lower shaft connecting by a hinge;

wherein the propeller assembly is retractable and the hinge bends such that the upper shaft may lies substantially horizontally over the saddle while the lower shaft remains in the passage; and wherein hinge may be straightened and the propeller assembly extended by moving the upper shaft at least partially into the passage.

10. The personal watercraft of claim 9, further comprising a collar attached to the upper shaft limiting its descent into the vertical passage.

11. The personal watercraft of claim 9, further comprising a motor support insert at least partially within the vertical passage, the motor support insert having a first configuration that retains the upper and lower shaft in a fixed coaxial relationship when the propeller unit is extended, and a second configuration where the motor support insert supports the upper shaft in a substantially horizontal position when the propeller unit is retracted.

12. The personal watercraft of claim 11, wherein the motor support insert has a movable wedge member that partially retains the upper shaft in the first configuration and provides a horizontal support in the second configuration.

13. The personal watercraft of claim 9 wherein the saddle provides a recess on each of two opposite ends, the recesses at least partially retaining an inflatable floatation member.

14. The personal watercraft of claim 13, wherein the saddle provides a retractable footrest on each of two opposite sides.

15. The personal watercraft of claim 14, wherein the footrests are attached to the saddle via hinges.

16. A personal watercraft comprising: a saddle having a seating surface and an adjacent vertical passageway through the saddle; a motor support insert at least partially occupying the vertical passageway; and a motor having an upper shaft with a control unit and hinged to a lower shaft with a propeller unit; wherein the support insert provides a first configuration that supports the motor with the propeller unit extended by retaining the upper and lower shaft in a fixed relationship but allowing rotation of the shafts, and the support insert provides a second configuration that allows the propeller unit to retract and the upper and lower shaft to bend relative to one another; with the upper shaft placed substantially horizontal on the saddle.

17. The personal watercraft of claim 16, wherein a wedge shaped member provides a horizontal surface that contacts the upper shaft when the propeller unit is extended, and moves with respect to the support insert to provide a substantially horizontal surface that contacts the upper shaft when the propeller unit is retracted.

18. The personal watercraft of claim 16, further comprising an electric battery retained within a cavity in the saddle, and connected to the motor.

19. The personal watercraft of claim 16, further comprising a floatation member that circumscribes the saddle.

* * * * *